US006382220B1

(12) United States Patent
Kefauver

(10) Patent No.: US 6,382,220 B1
(45) Date of Patent: May 7, 2002

(54) DEVICE FOR CLEANING A COLOR BANK

(75) Inventor: Lewis Bryan Kefauver, Bel Air, MD (US)

(73) Assignee: EFC Systems, Inc., Havre de Grace, MD (US)

( * ) Notice: Subject to any disclaimer, the term of this patent is extended or adjusted under 35 U.S.C. 154(b) by 0 days.

(21) Appl. No.: 09/492,890

(22) Filed: Jan. 27, 2000

(51) Int. Cl.[7] ..... B08B 9/00; B08B 9/02

(52) U.S. Cl. ..... 134/22.1; 134/22.11; 134/22.12; 134/22.18; 134/36; 134/38; 134/100.1; 134/102.1; 134/166 C; 134/166 R

(58) Field of Search ..... 134/36, 37, 38, 134/22.1, 22.12, 22.18, 100.1, 102.1, 102.2, 166 C, 166 R, 169 C

(56) References Cited

U.S. PATENT DOCUMENTS

| | | | | |
|---|---|---|---|---|
| 1,256,852 A | | 2/1918 | Warner | |
| 3,290,169 A | | 12/1966 | Sedlacsik, Jr. | 117/93.41 |
| 3,348,774 A | * | 10/1967 | Wiggins | 239/70 |
| 4,487,367 A | * | 12/1984 | Perry et al. | 239/112 |
| 4,549,676 A | * | 10/1985 | Gerich | 222/145 |
| 4,902,352 A | | 2/1990 | Christian | 134/22.12 |
| 5,287,867 A | | 2/1994 | Plummer et al. | 134/56 R |
| 5,289,947 A | | 3/1994 | Akeel et al. | 222/108 |
| 5,322,571 A | | 6/1994 | Plummer et al. | 134/22.12 |
| 5,803,109 A | * | 9/1998 | Rosen | 137/15 |
| 5,876,508 A | * | 3/1999 | Wu et al. | 134/2 |

* cited by examiner

*Primary Examiner*—Randy Gulakowski
*Assistant Examiner*—Saeed Chaudhry
(74) *Attorney, Agent, or Firm*—Leonard Bloom; Robert M. Gamson

(57) ABSTRACT

A device for supplying a mixture of fluids (cleaning agent and air) to a color bank in a paint finishing system for the purpose of removing paint residue, thereby flushing out the system. The device, may be supplied with any number and types of fluids. The device comprises valves for the purpose of activating fluid flow, an overall shape that allows for easing mounting in an existing color changer rack system or as an independent device, and a screen plate located in the path of the fluids, for the purpose of mixing the fluids. A screen plate and discharge port is configured into the body of the device to deliver the cleaning fluid mixture in a turbulent swirling movement to the next section of the color bank or to the next item to be cleaned. A method of cleaning a color bank using the device is disclosed.

14 Claims, 6 Drawing Sheets

DEVICE FOR CLEANING A COLOR BANK

BACKGROUND OF THE INVENTION

1. Field of the Invention

This invention relates to a cleaning device used primarily in the paint finishing industry, and particularly to an improved cleaning device which produces a turbulent mix of air and cleaning agent.

2. Description of Related Art

Solvents and cleaning agents are most often used to clean paint finishing systems and equipment that use acrylic, lacquer, epoxy, urethanes and enamel-based paints. Prior art generally use a combination of solvent and air to flush out and remove paint remnants. In U.S. Pat. No. 5,290,169 to Sedlacsik, Jr. discloses a method of removing excess paint from freshly-coated articles.

An electrostatic field is formed between the articles and an electrode. A solvent and compressed air are fed periodically to the central portion of the electrode, and the electrode is moved periodically to distribute the solvent. Christian, in U.S. Pat. No. 4,902,352 discloses cleaning a paint system using pressurized air and a metered flow of solvent. The pressurized air atomizes the solvent by a venturi effect and propels it though the supply line to clean the supply line. In U.S. Pat. No. 5,289,947, Akeel et al disclose a system for changing the paint colors, in production, and cleaning the paint lines. The system employs a plurality of magazine-fed slugs which are propelled through the supply line to clean paint off of the interior walls of the supply line. Plummer et al, in U.S. Pat. Nos. 5,287,867 and 5,322,867 disclose a system for controlling the turbulent flow of a pressurized mixture of a gas and a cleaning fluid for purging and cleaning ducts and a method and apparatus for cleaning liquid carrying hoses using a turbulent solvent/compressed air mixture. U.S. Pat. No. 1,256,852 to Warner discloses a device in which water and steam are mixed and the heated water flows out through perforations in the wall of the mixing chamber.

BRIEF SUMMARY OF THE INVENTION

It is an object of the present invention to provide a device to mix air and cleaning agent to produce a turbulent mixture which is pulsating and swirling and which efficiently cleans a surface or system.

It is further object of the present invention to minimize the amount of cleaning agent to be used to reduce air pollution.

It is another object of the present invention to provide an apparatus and method which cleans rapidly and efficiently.

In accordance with the teachings of the present invention there is disclosed a device for cleaning surfaces and enclosed systems. The device has a housing having therein a chamber, the chamber having an outlet and at least two inlets. Air is introduced, under pressure, into one of the at least two inlets. A cleaning agent is introduced, under pressure, into another of the at least two inlets. Means are provided to control the rate of flow of air and cleaning agent in each of the at least two inlets. Controlled flow rates of cleaning agent and air are introduced into the chamber under pressure. A screen plate is disposed in the outlet of the chamber. The screen plate has a plurality of spaced-apart openings therein to produce turbulence in the air/cleaning agent mixture as the air/cleaning agent mixture exits the outlet through the screen plate. In this manner, a turbulent mixture of air and cleaning agent exits the outlet of the housing. The turbulent mixture is introduced into a system to be cleaned of substances removable by the cleaning agent, the swirling movement increasing the cleaning efficiency and reducing the amount of cleaning agent required.

In further accordance with the teachings of the present invention, there is disclosed a device for use in the paint industry for cleaning a color bank. The color bank has a plurality of units, each unit having therein a different color paint. The device has a housing having a chamber therein. The chamber has an outlet and at least two inlets. Air, under pressure, is introduced into one of the at least two inlets. Cleaning agent, under pressure, is introduced into another of the at least two inlets. At least two microvalve assemblies are provided, a respective one of microvalve assemblies being connected to a corresponding one of the at least two inlets such that the rate of flow in the corresponding inlet may be controlled, as the cleaning agent and air are introduced into the chamber. A screen plate is disposed in the outlet of the chamber. The screen plate has a plurality of spaced apart openings therein. The openings are formed at an angle with respect to an axial center line through the screen plate. A turbulent mixture of air and cleaning agent exits the outlet through the screen plate. The turbulent mixture is introduced into the color bank. The turbulent movement increases cleaning efficiency and reduces the amount of cleaning agent required.

In still further accordance with the teachings of the present invention, there is disclosed a device for cleaning a color bank in the paint industry. The device has a housing having at least two inlets and an outlet. Air under pressure is introduced into one of the at least two inlets. Cleaning agent, under pressure, is introduced into another of the at least two inlets. A receiving stage is in the housing in which the air and cleaning agent are received. A mixing stage is in the housing in which the air and cleaning agent are mixed. A discharge stage is in the output of the housing in which the air/cleaning agent mixture is delivered in a turbulent motion. The turbulent mixture is introduced into the color bank to effect an efficient, rapid cleaning.

In another aspect there is disclosed a method of cleaning a color bank in the paint industry. The color bank has a plurality of interconnected units, each unit having therein a different color paint. The method has the following steps. A device is provided a housing. The housing having therein a chamber having an outlet and at least two inlets. Into one of the at least two inlets, there is introduced air under pressure. Into another of the at least two inlets, there is introduced cleaning agent under pressure. The air and cleaning agent are mixed in the chamber. A screen plate is provided having a plurality of spaced-apart openings therein. The screen plate is disposed in the outlet of the chamber such that the air/cleaning agent mixture exits the outlet with a turbulent motion. The turbulent air/cleaning agent mixture is introduced into the color bank such that the turbulent air/cleaning agent mixture passes through each unit of the color bank and efficiently cleans residual color paint from each unit.

These and other objects of the present invention will become apparent from a reading of the following specification taken in conjunction with the enclosed drawings.

DESCRIPTION

In the paint finishing industry, paint is frequently delivered to the atomizer via color banks.

Each color bank (in general, a manifold) houses one or more valve mechanisms, fluid inlets (for paint) and outlets (for recirculating the paint) and air lines for triggering the valves. These color banks may be joined together in series, each sharing a common fluid outlet. Because the banks share a common fluid outlet, the banks need to be flushed with a cleaning agent during a paint color change.

There are many instances in which two or more fluids need to be thoroughly combined in order to achieve a mixture that will be utilized for a specific purpose. One such instance is the mixing of a two component epoxy. Another is the mixing of a cleaning agent with air in order to create a foaming, bubbly mixture. This foamy mixture creates a "scrubbing" action that aids in the cleaning process.

Figure 1:
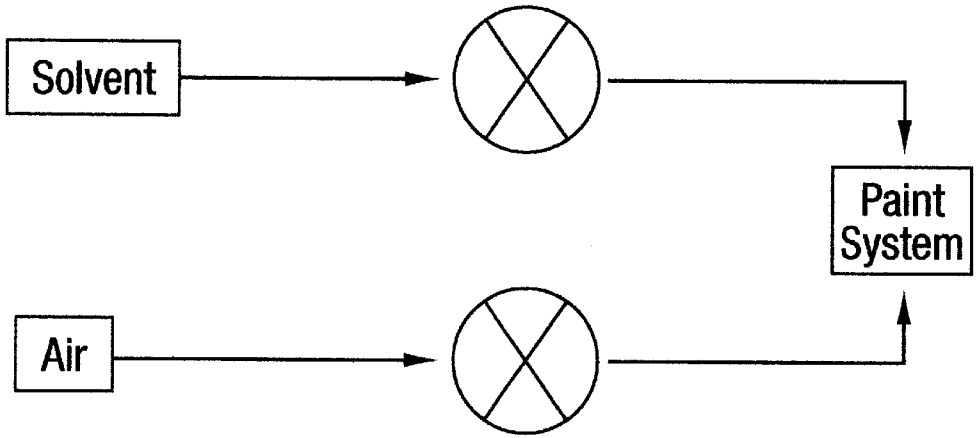
Fig. 1 Prior Art
FIG. 1 is a diagram of the cleaning system of the prior art.

The prior art (FIG. 1) introduced a mixture of air and solvent into a paint system to clean the system of residual paint and to prepare the paint system for use with a different color(s) without cross contamination. The prior art uses independently controlled valves in the incoming lines for air and solvent. The valves are opened and closed very rapidly to create surges of fluid (air and/or solvent) so that a scrubbing action can be produced in the paint system which is to be cleaned.

Figure 2:
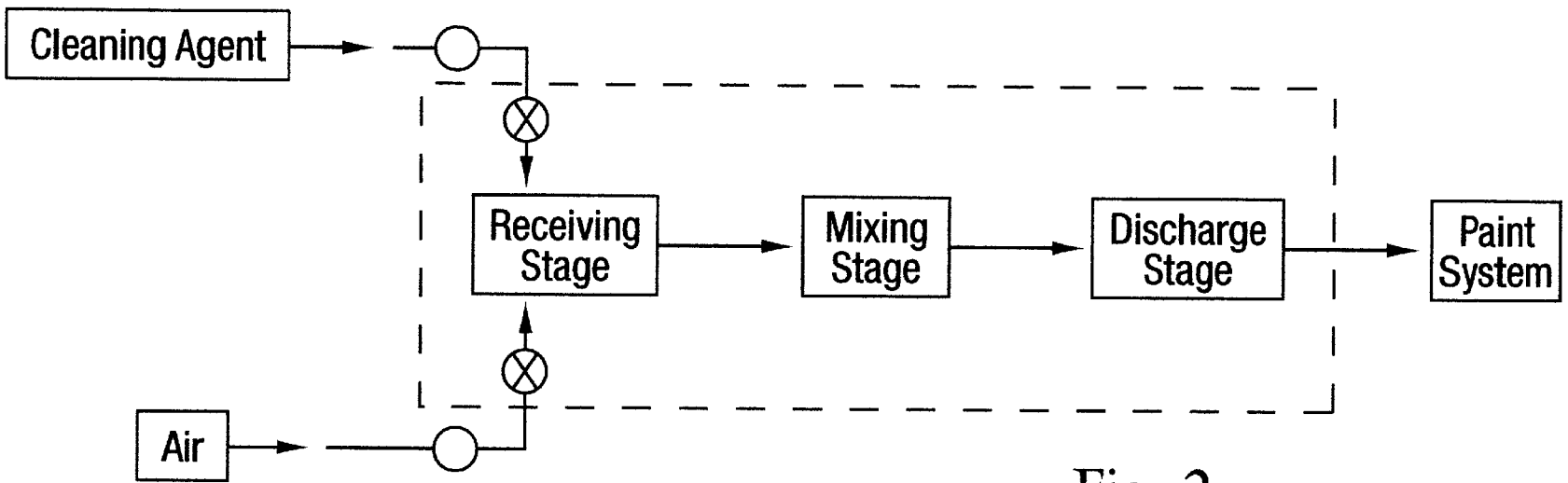
FIG. 2 is a diagram of the cleaning system of the present invention.
Figure 3:
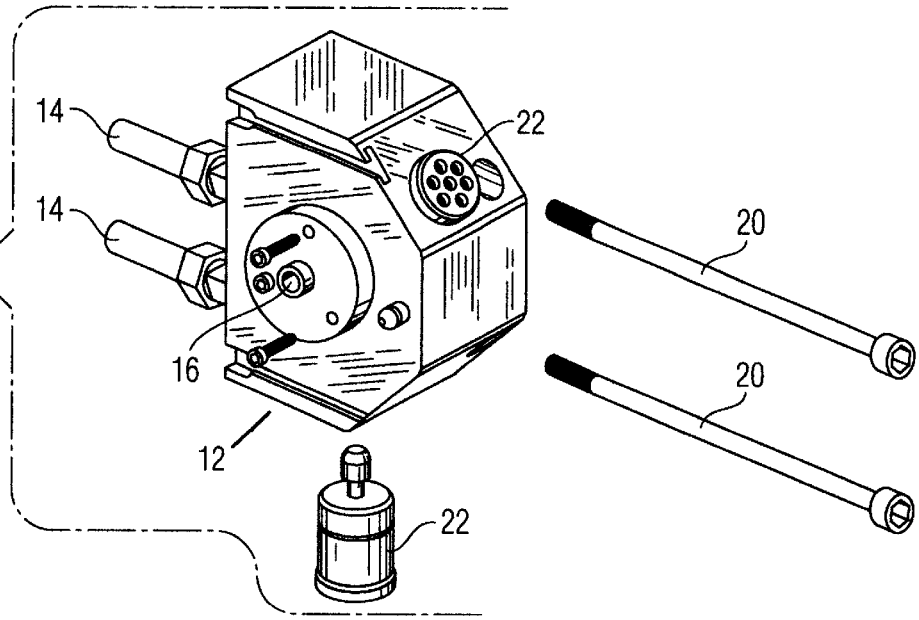
FIG. 3 is a perspective view of the device of the present invention.
Figure 4:
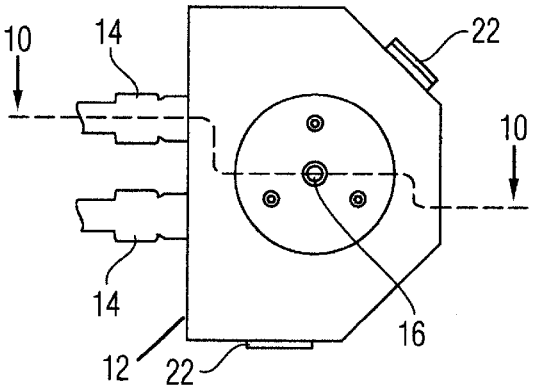
FIG. 4 is a side elevation view of FIG. 3.
Figure 5:
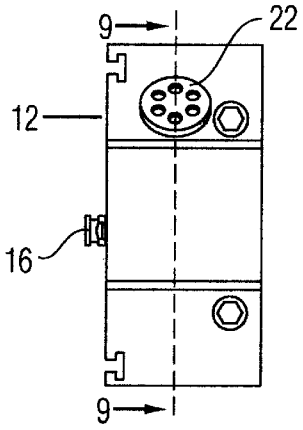
FIG. 5 is a front elevation view of FIG. 3.
Figure 6:
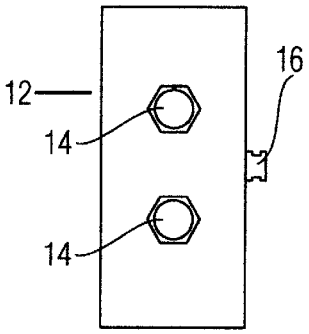
FIG. 6 is a rear elevation view of FIG. 3.
Figure 7:
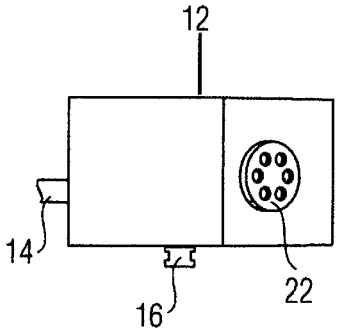
FIG. 7 is a top plan view of FIG. 3.
Figure 8:
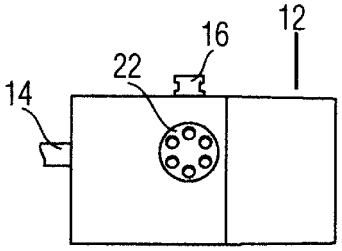
FIG. 8 is a bottom plan view of FIG. 3.
Figure 9:
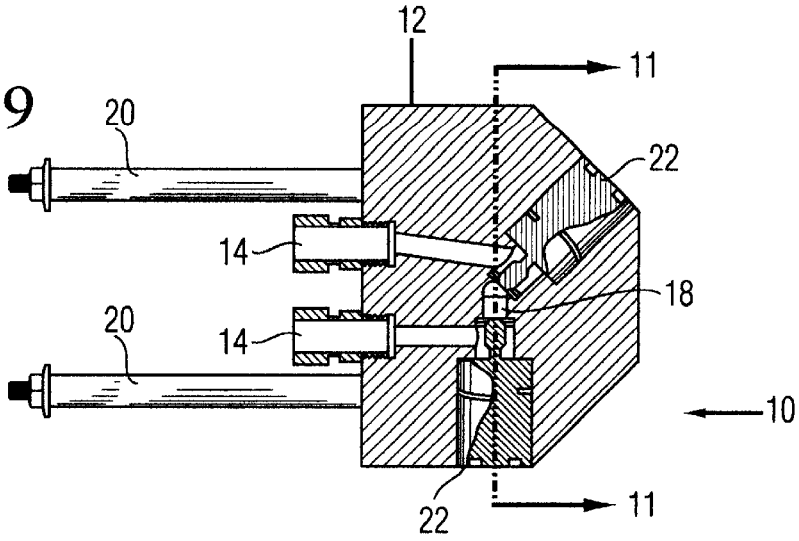
FIG. 9 is a cross-section view taken across the lines 9—9 of FIG. 5.
Figure 10:
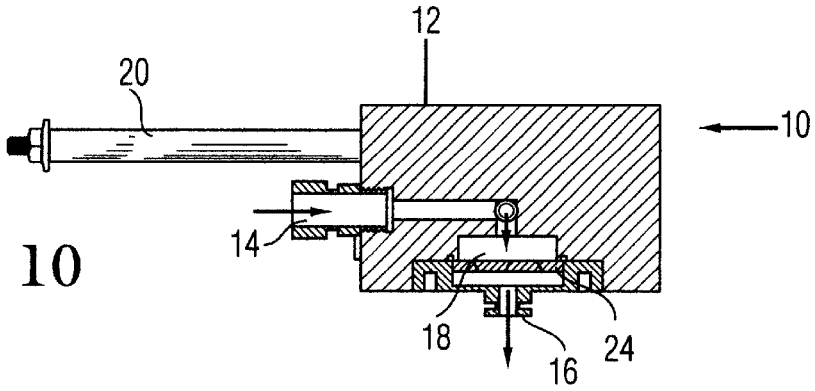
FIG. 10 is a cross-section view taken across the lines 10—10 of FIG. 4.
Figure 11:
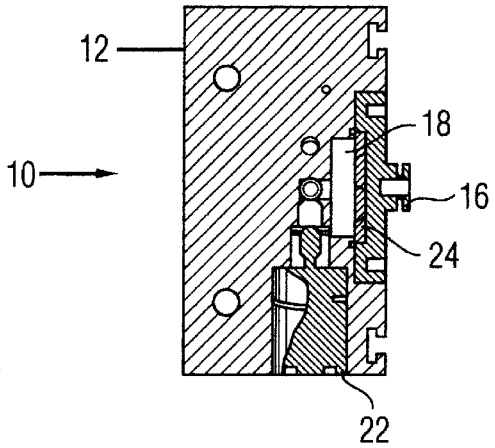
FIG. 11 is a cross-section view taken across the lines 11—11 of FIG. 9.

As shown in FIG. 2, the present invention is a system in which air, under pressure, is introduced into one of the outlets and cleaning agent, under pressure is introduced into another of the inlets. The cleaning agent may be a solvent such as an organic liquid or an aqueous carrier for a cleaner. The aqueous carrier may be deionized water. The cleaner may be a detergent, surfactant or other cleaners known to persons skilled in the art. These fluids are received in a first receiving stage in the device. The fluids (air and cleaning agent) are mixed in a second, mixing stage and the mixed air/cleaning agent exits through a third, discharge stage. The air/cleaning agent mixture is delivered from the discharge stage of the housing with a turbulent motion which may swirl and/or pulsate and is introduced into the color bank to effect an efficient, rapidly cleaning. The present invention controls the rate of flow of fluid in the air and cleaning agent inlets in order to obtain a desired ratio of air to cleaning agent but the control does not open and shut the valves as in the prior art. Rather, the rate of flow is controlled through the inlet so that on and off operation of the valves is not required. The turbulence produced in the outlet is due to the design of the present invention and not due to the rapid intermittent flow of fluid in the system.

As shown in FIGS. 3–11, the device 10 of the present invention has a housing 12 which has at least two inlets 14 and an outlet 16 connected to a chamber 18 within the housing 12. Threaded bolts 20, or other support means known to persons skilled in the art, support the housing 12 for mounting on a surface. Air, under pressure, is introduced into one of the at least two inlets 14 and cleaning agent, under pressure, is introduced into another of the at least two inlets 14. If more than one cleaning agent is desired, more than two inlets 14 are provided in the housing 12 and additional cleaning agents, as desired, are introduced under pressure into the additional inlets 14. This is the first receiving stage of the device 10.

Each inlet 14 is provided with a means to individually control the flow of fluid in the respective inlet. Preferably, the means is an individual regulator for each inlet, each of which being preset for uninterrupted flow. The flow into each inlet is controlled to vary the ratio of cleaning agent to air.

The controlled flow rate of air and cleaning agent are introduced into the chamber 18 via separate microvalve assemblies 22 within the housing where the air and cleaning agent mix. The configuration of the chamber 18 may be rectangular, square, round, oval, conical etc. This is the second mixing stage of the device. Preferably, the inlets 14 are approximately at right angles to the chamber 18.

Figure 14:
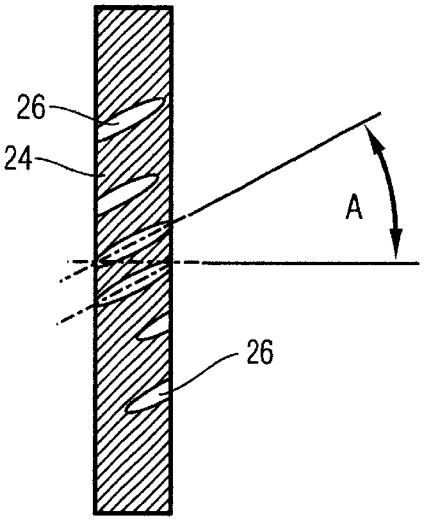
FIG. 14 is a cross-section view taken across the lines 14—14 of FIG. 12.
Figure 13:
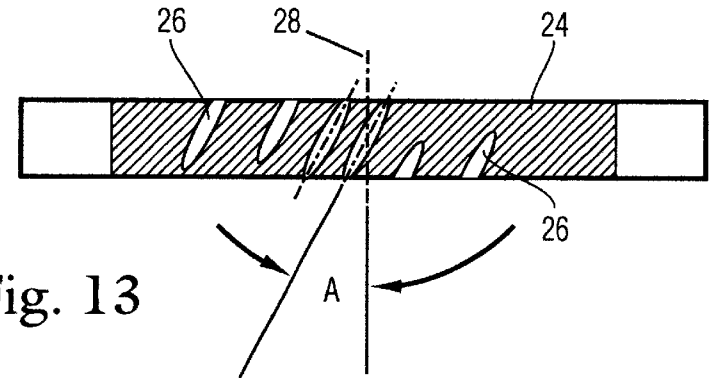
FIG. 13 is a cross-section view taken along the lines 13—13 of FIG. 12.
Figure 12:
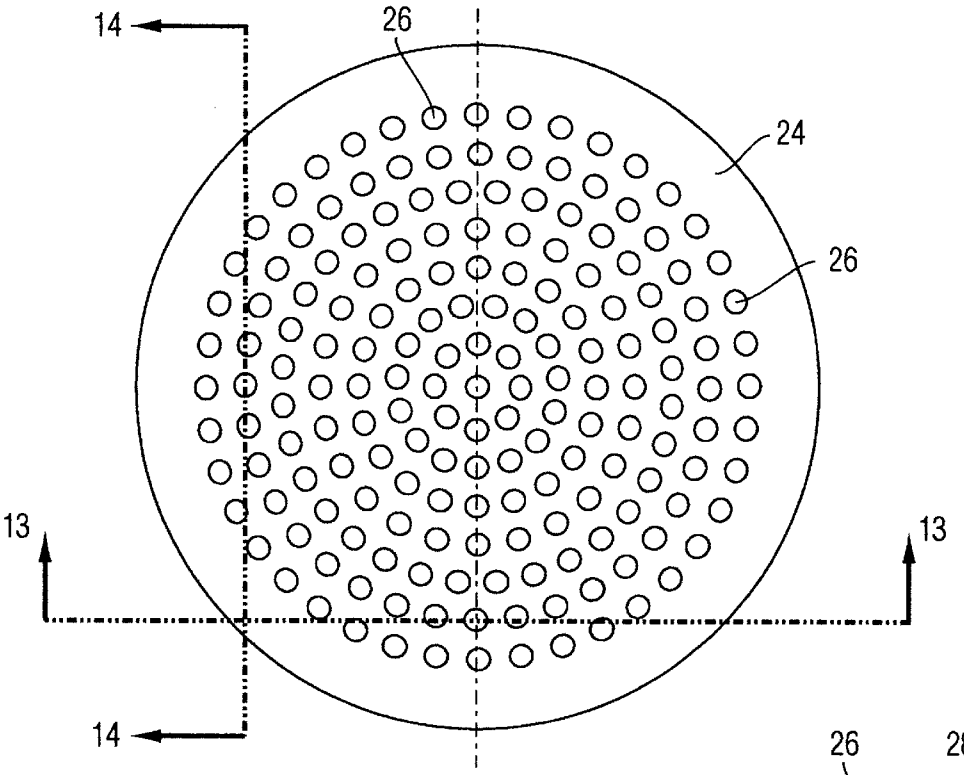
FIG. 12 is an enlarged top plan view of the screen plate.

The mix of cleaning agent and air, under pressure, is forced from the outlet 16 of the chamber 18 through a screen plate 24. Preferably, the outlet 16 is approximately at right angles to the inlets 14. The screen plate 24 has a plurality of spaced-apart openings 26 formed therein. The screen plate 24 may be constructed of a porous material, a mesh or a disc with the openings machined, molded or cast therein. Each of the openings 26 in the screen plate 24 are at an angle A with respect to an axial center line 28 through the screen plate 24. Preferably, the angle A is 25°±20° (FIGS. 12–14). The openings 26 in the screen plate are disposed in a pattern which may be selected for most efficient operation. The pattern may be a series of concentric circles of increasing diameter but other configurations may be used. The size, location, number and orientation of the openings 26 may be varied to achieve the desired cleaning effects. This is the third, discharge stage. Due to the openings 26 in the screen plate, the cleaning agent/air mixture exiting through the outlet 16 acquires a turbulent, movement which is pulsating and swirling. The mixture appears to be foaming and bubbling.

Figure 15:
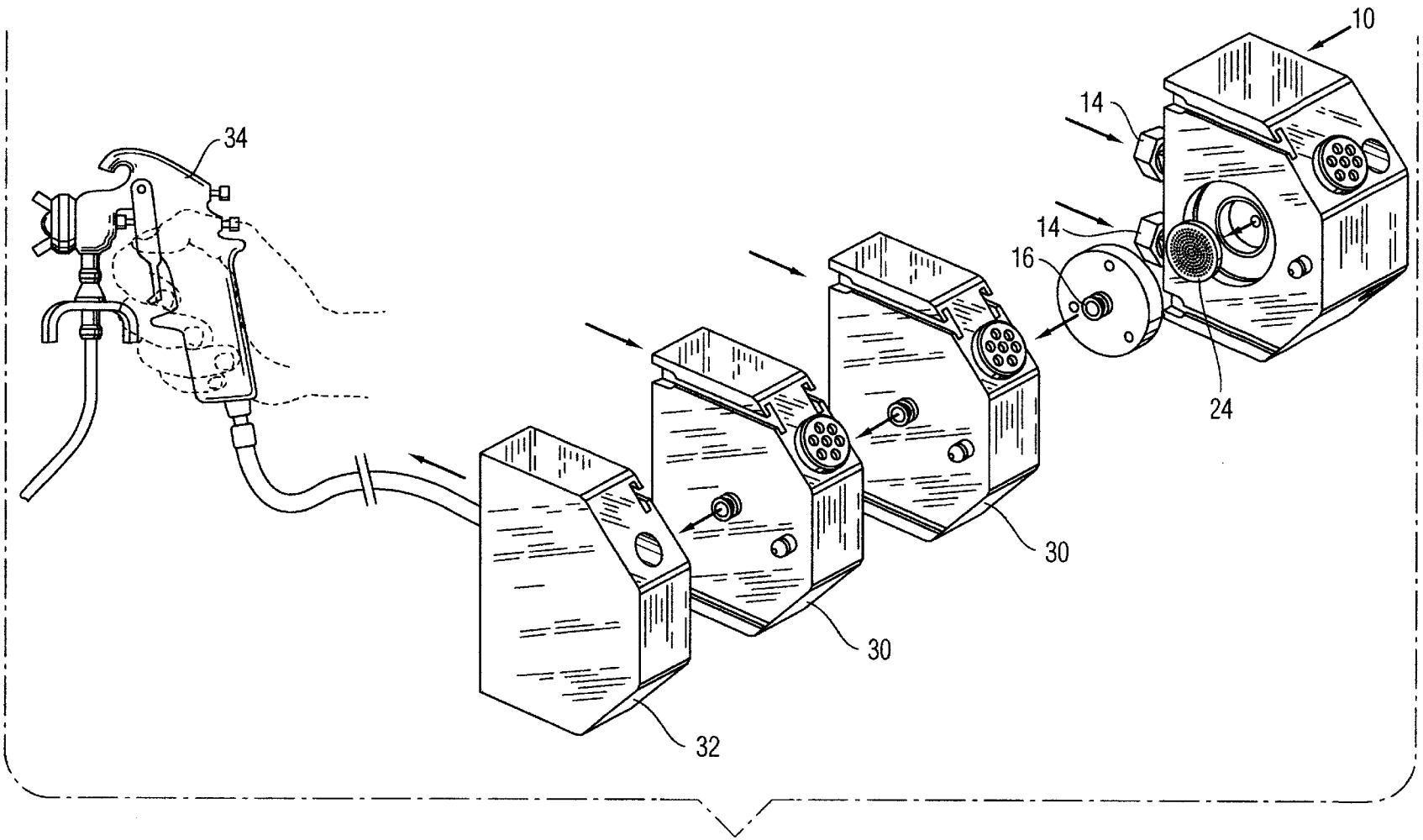
FIG. 15 is a perspective view showing the device of the present invention connected to a bank of color units.
Figure 16:
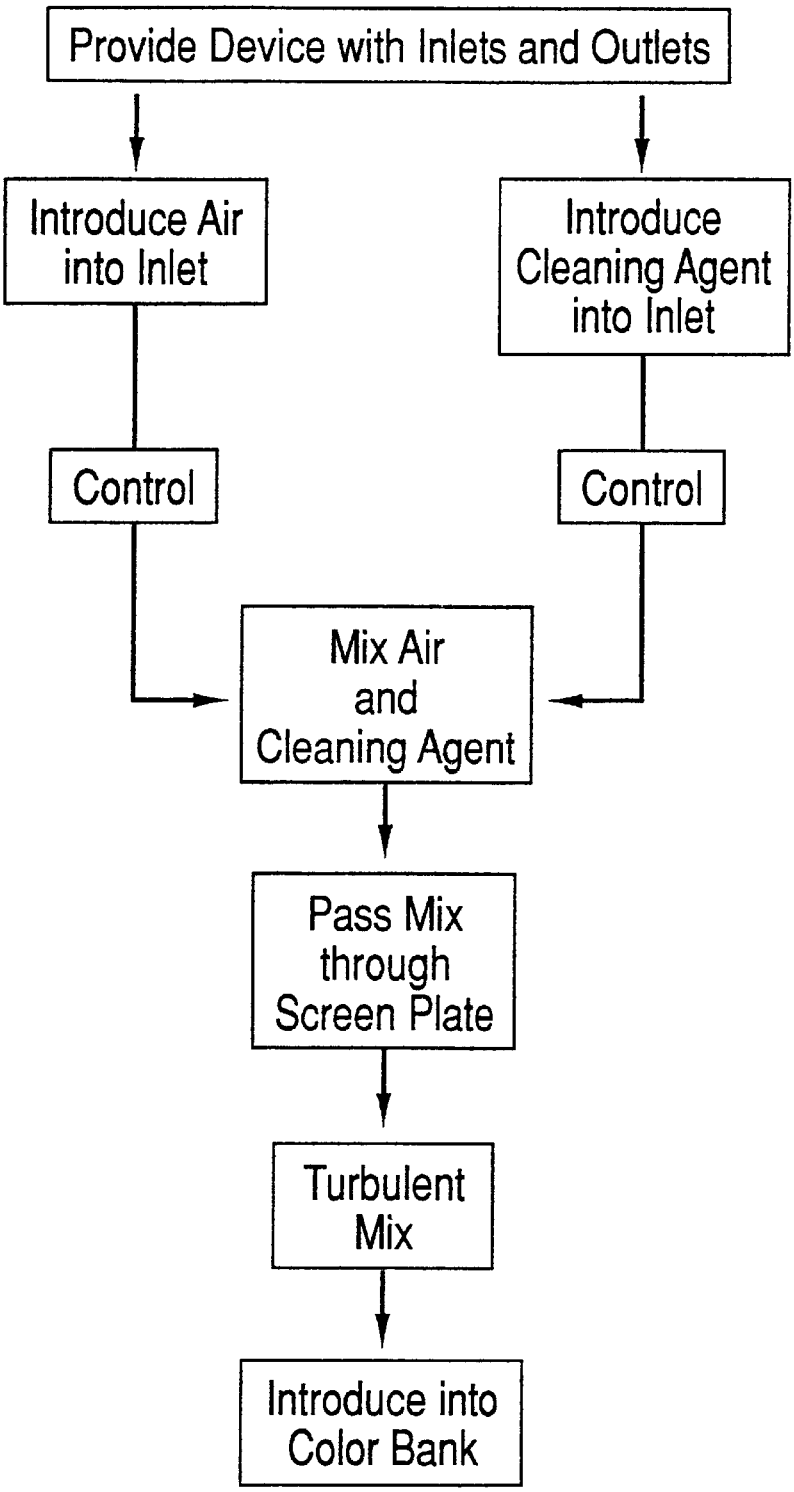
FIG. 16 is a diagram showing the method of using the device of the present invention.

As shown in FIG. 15, the turbulent air/cleaning agent mixture is introduced into the system to be cleaned such as a color bank which is used for supplying paint to an atomizer 34. The present device 10 was configured to resemble the color bank units 30. The color bank usually consists of several color bank units 30 which are arranged in series and generally have a different color in each unit 30. Each unit 30 has a separately controlled inlet with a means for shutting the inlet. The outlet of each color bank unit 30 may be introduced into the adjoining color bank unit 30 so that the colors may be mixed and introduced sequentially to each succeeding color bank unit 30. The final paint product from the end unit 32 is directed to an atomizer or spray head 34 to direct the paint to the item to be painted. When the device 10 of the present invention is connected to the first unit 30 of the color bank, the cleaning agent/air mixture from the device 10 enters the color bank units 30 successively and dissolves or removes the residual paint in each unit 30. The turbulence of the air/cleaning agent mixture from the present device 10 very efficiently flushes the color bank and removes the paint from all of the color units 30. The air/cleaning agent mix with the removed paint is collected for disposal or other use. This sequence of events is shown in FIG. 16.

Preferably, the device 10 of the present invention is located distal from the end unit 32 and proximal to the first unit. Many benefits are obtained with the device 10 of the present invention. First, the cleaning agent and air are thoroughly mixed, creating a foaming action that is beneficial in the "scrubbing" of all surfaces exposed to the paint inside the color bank series. Second, the turbulent action generates an extremely vigorous flow mixture that increases cleaning power. Thirdly, changing the screen plate and/or varying the operation of the air and cleaning agent microvalve assemblies may vary the cleaning process quite easily. And finally, the overall efficiency of the cleaning process is improved, thereby resulting in faster cleaning cycles, and reduced cleaning agent usage and emissions. This is beneficial to the environment.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A device for cleaning surfaces and enclosed systems comprising:

a housing having therein a single chamber, the chamber having an outlet and at least two inlets, air introduced, under pressure, into one of the at least two inlets, a cleaning agent introduced, under pressure, into another of the at least two inlets, means to control the rate of flow of air and cleaning agent in each of the at least two inlets, wherein controlled flow rates of cleaning agent and air are introduced into the chamber under pressure forming a mixture of air and cleaning agent therein, a single screen plate disposed in the outlet of the chamber, the screen plate having a plurality of spaced-apart openings therein to produce turbulence in the mixture of air and cleaning agent as the mixture of air and cleaning agent exits the outlet through the screen plate, wherein each of the openings in the screen plate is formed at an angle of 25°±20° with respect to an axial center line through the screen plate, wherein a turbulent mixture of air and cleaning agent exits the outlet of the housing, the turbulent mixture being introduced into a system to be cleaned of substances removable by the cleaning agent, the turbulent movement increasing the cleaning efficiency and reducing the amount of cleaning agent required.

2. The device of claim 1, wherein a second cleaning agent is introduced, under pressure, into a third inlet, the second cleaning agent mixing with the cleaning agent and air in the chamber.

3. The device of claim 1, wherein the means to control the rate of flow via regulators to each of the at least two inlets is a separate microvalve assembly connected to each respective inlet.

4. The device of claim 3, wherein the regulator assemblies are mounted in the housing.

5. The device of claim 1, wherein the openings in the screen plate are in a series of concentric circles of increasing diameter.

6. The device of claim 1, wherein the chamber and the outlet from the chamber are approximately at right angles with respect to the at least two inlets to the chamber.

7. The device of claim 1, wherein the system to be cleaned is a color bank used in the paint finishing industry.

8. A device for use in the paint industry for cleaning a color bank, the color bank having a plurality of interconnected units, each unit having therein a different color paint, the device comprising:

a housing having a chamber therein, the chamber having an outlet and at least two inlets, air, under pressure, introduced into one of the at least two inlets, cleaning agent, under pressure, introduced into another of the at least two inlets, at least two microvalve assemblies, a respective one of microvalve assemblies being connected to a corresponding one of the at least two inlets such that the rate of flow in the corresponding inlet may be controlled as the cleaning agent and air are introduced into the chamber, a screen plate being disposed in the outlet of the chamber, the screen plate having a plurality of spaced-apart openings therein, the openings being formed at an angle with respect to an axial center line through the screen plate producing pulsations in the mixture of air and cleaning agent, wherein the angle of each of the openings in the screen plate is 25°±20°, wherein a turbulent mixture of air and cleaning agent exits the outlet through the screen plate, the pulsating, swirling mixture being introduced into the color bank, the turbulent movement increasing cleaning efficiency and reducing the amount of cleaning agent required for cleaning the color bank.

9. The device of claim 8, wherein a second cleaning agent, under pressure, is introduced into a third outlet, the second cleaning agent mixing with the cleaning agent and the air in the chamber.

10. The device of claim 8, wherein the at least two microvalve assemblies are mounted in the housing.

11. The device of claim 8, wherein the opening in the screen plate are in a series of concentric circles of increasing diameter.

12. A method of cleaning a color bank in the paint industry, the color bank having a plurality of interconnected units, each unit having therein a different color paint, the method comprising the steps of:

providing a device having a housing, the housing having therein a chamber having an outlet and at least two inlets, introducing into one of the at least two inlets, air under pressure, introducing into another of the at least two inlets, cleaning agent under pressure, mixing the air and cleaning agent in the chamber, providing a screen plate having a plurality of spaced-apart openings therein, disposing the screen plate in the outlet of the chamber such that the mixture of air and cleaning agent exits the outlet with a turbulent motion, introducing the turbulent mixture of air and cleaning agent into the color bank such that the turbulent mixture of air and cleaning agent passes through each unit of the color bank and efficiently cleans residual color paint from each unit.

13. A device for use in the paint industry for cleaning a color bank comprising:

a housing having a chamber therein, inlets for introducing a cleaning agent and pressurized air into the chamber, the chamber having an outlet, a screen plate disposed at the outlet of the chamber, the screen plate having a plurality of spaced-apart openings formed therein, the openings being formed at an angle of 25°±20° with respect to an axial center line through the screen plate, thereby producing swirling pulsations in the mixture of air and cleaning agent, wherein a turbulent mixture of the air and cleaning agent exits the chamber and enters the color bank for efficient cleaning of the color bank.

14. A method of cleaning a color bank in the paint industry comprising the steps of:

providing a chamber for mixing air and solvent therein, the chamber having an outlet, providing a screen plate having a plurality of spaced-apart openings therein, the openings being formed at an angle of 25°±20° with respect to an axial center line through the screen plate swirling and pulsating the air and solvent mixture through the color bank to efficiently clean the color bank.

* * * * *